US011581159B2

(12) United States Patent
Gibson

(10) Patent No.: US 11,581,159 B2
(45) Date of Patent: Feb. 14, 2023

(54) CIRCUIT INTERRUPTERS WITH GROUND FAULT MODULES AND RELATED METHODS

(71) Applicant: Eaton Intelligent Power Limited, Dublin (IE)

(72) Inventor: Jeffrey Scott Gibson, Hookstown, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 563 days.

(21) Appl. No.: 16/558,636

(22) Filed: Sep. 3, 2019

(65) Prior Publication Data

US 2021/0066014 A1 Mar. 4, 2021

(51) Int. Cl.

| | |
|---|---|
| ***H01H 71/24*** | (2006.01) |
| ***H01H 71/52*** | (2006.01) |
| ***H01H 71/02*** | (2006.01) |
| ***H01H 83/20*** | (2006.01) |
| ***H01H 33/04*** | (2006.01) |
| ***H01H 71/12*** | (2006.01) |

(52) U.S. Cl.

CPC ..... *H01H 71/24* (2013.01); *H01H 33/04* (2013.01); *H01H 71/02* (2013.01); *H01H 71/123* (2013.01); *H01H 71/521* (2013.01); *H01H 83/20* (2013.01); *H01H 2083/201* (2013.01)

(58) Field of Classification Search

CPC . H01H 71/123; H01H 83/20; H01H 2083/201
See application file for complete search history.

(56) References Cited

U.S. PATENT DOCUMENTS

| | | | | |
|---|---|---|---|---|
| 4,503,408 | A | 3/1985 | Mrenna et al. | |
| 4,568,899 | A * | 2/1986 | May | H01H 83/20 335/20 |
| 4,736,174 | A | 4/1988 | Castonguay et al. | |
| 4,786,885 | A | 11/1988 | Morris et al. | |
| 5,117,211 | A | 5/1992 | Morgan et al. | |
| 6,232,857 | B1 * | 5/2001 | Mason, Jr. | H01H 83/144 335/35 |
| 6,239,962 | B1 * | 5/2001 | Seymour | H01H 83/226 361/115 |
| 6,545,574 | B1 * | 4/2003 | Seymour | H01H 71/0271 335/18 |
| 6,784,770 | B2 * | 8/2004 | Gimenez | H01H 83/144 335/132 |
| 7,936,241 | B2 * | 5/2011 | Drexler | H01H 71/08 200/293 |
| 8,222,983 | B2 | 7/2012 | Zhou et al. | |
| 9,202,655 | B2 * | 12/2015 | Bertrand | H01H 11/0062 |

(Continued)

*Primary Examiner* — Alexander Talpalatski
(74) *Attorney, Agent, or Firm* — Eckert Seamans Cherin & Mellott, LLC

(57) ABSTRACT

Circuit interrupter devices have a first housing with a circuit interrupter, a second housing coupled to the first housing, a ground fault circuit and current transformer in the second housing. The current transformer has an open channel. The circuit interrupter devices also include at least one power conductor having a rigid or semi-rigid body with opposing first and second end portions extending between the first and second housings. The second end portion of the at least one power conductor extends through the open channel in the current transformer and terminates in a breaker load collar(s).

15 Claims, 6 Drawing Sheets

(56) References Cited

U.S. PATENT DOCUMENTS

| | | | | |
|---|---|---|---|---|
| 10,249,464 | B2 * | 4/2019 | Hiremath | H01H 71/025 |
| 10,867,767 | B2 * | 12/2020 | Lathrop | H01H 9/02 |
| 10,958,063 | B2 * | 3/2021 | Jimenez | H01H 71/00 |
| 2017/0110281 | A1 * | 4/2017 | Lathrop | H01H 71/0228 |
| 2017/0338072 | A1 * | 11/2017 | Hiremath | H01H 11/0031 |
| 2019/0109452 | A1 * | 4/2019 | Jimenez | H05K 13/0015 |

* cited by examiner

CIRCUIT INTERRUPTERS WITH GROUND FAULT MODULES AND RELATED METHODS

FIELD OF THE INVENTION

The present invention relates to circuit interrupters.

BACKGROUND OF THE INVENTION

Circuit interrupters such as circuit breakers are one of a variety of overcurrent protection devices used for circuit protection and isolation. The circuit breaker provides electrical protection whenever an electric abnormality occurs. In a typical circuit breaker, current enters the system from a power line and passes through a line conductor to a stationary contact fixed on the line conductor, then to a movable contact. The movable contact is fixedly attached to a pivoting arm. Arc chutes can be used to direct an arc away from the electrical contacts into the arc chute. The arc chute is situated proximate to the stationary contact of the circuit. As long as the stationary and movable contacts are in physical contact, current passes between the stationary contact and the movable contact and out of the circuit breaker to down-line electrical devices.

In the event of an overcurrent condition (e.g., a short circuit), extremely high electromagnetic forces can be generated. The electromagnetic forces can be used to separate the movable contact from the stationary contact. Upon separation of the contacts and blowing open the circuit, an arcing condition occurs. The breaker's trip unit will trip the breaker which will cause the contacts to separate. Also, arcing can occur during normal "ON/OFF" operations of the breaker.

Conventional ground fault circuits reside inside a housing of the circuit breaker placing sensitive electronics relatively close to arcing components which can limit amperage and interrupting levels. Also, conventional thermal magnetic circuit breakers with ground fault circuits have complicated wiring arrangements making assembly challenging.

SUMMARY OF EMBODIMENTS OF THE INVENTION

Embodiments of the invention are directed to plug-on ground fault modules with pass-through power conductors for circuit interrupters such as circuit breakers.

The circuit interrupter can be a thermal magnetic single pole, two pole or three pole circuit breaker having a rating in a range of 10 A-200 A.

Embodiments of the invention are directed to a circuit interrupter device having a first housing with a circuit interrupter, a second housing coupled to the first housing. The second housing has a current transformer and at least one load collar. The current transformer has an open through-channel. The circuit interrupter device also includes at least one power conductor having a rigid or semi-rigid body with opposing first and second end portions extending between the first and second housings. The second end portion extends through the open channel in the current transformer and into a load collar.

The second housing can further include a ground fault circuit and the at least one power conductor can be provided as a plurality of power conductors with each power conductor extending through the open channel of the current transformer.

The first end portion of the at least one power conductor can be coupled to the first housing. The second end portion of the at least one power conductor can be a free end portion that extends into the second housing through the open channel in the current transformer and into a load collar.

The circuit interrupter device can further include a support member coupled to the first housing and also coupled to a segment of the at least one power conductor.

The support member can be inclined and extend external of the first housing into the second housing.

The rigid or semi-rigid body of the at least one power conductor can have a first end portion that is perpendicular to the second end portion.

The rigid or semi-rigid body of the at least one power conductor can have an intermediate segment between the first and second end portions that extends at an angle between 30-60 degrees from the second end portion.

The circuit interrupter device can further include at least one printed circuit board in the second housing that can have a primary surface that is perpendicular to the second end portion of the at least one power conductor and that is adjacent the current transformer.

The primary surface of the at least one printed circuit board can be parallel to a primary body of the current transformer in the second housing.

The circuit interrupter device can further include a solenoid in the second housing that can be coupled to the printed circuit board and that can face the first housing, aligned with a cooperating trip lever in the first housing.

The at least one printed circuit board can be parallel to a primary body of the current transformer and can reside closer to the first housing than the current transformer.

The circuit interrupter device can further include a neutral conductor coupled to a neutral collar in the second housing.

The printed circuit board can have at least one through-channel. The at least one power conductor can extend through the at least one through-channel of the printed circuit board, then through the open channel in the current transformer, then into the at least one load collar. The neutral conductor can also extend through the open channel of the current transformer.

The at least one power conductor can be provided as a plurality of adjacent and parallel power conductors that concurrently extend through the open channel of the current transformer.

The circuit interrupter device can be a two pole device.

The second housing can include a ground fault circuit that is coupled to a circuit breaker as the circuit interrupter in the first housing.

The first housing and the second housing can each comprise apertures on first and second spaced apart corner portions that are sized and configured for receiving a fixation member to attach the first housing to the second housing.

Other embodiments are directed to a ground fault assembly that includes: a housing with a plurality of load collars; a printed circuit board coupled to a trip solenoid in the housing; and a current transformer in the housing comprising a body defining a center through-channel residing adjacent the printed circuit board. The body of the current transformer is parallel to and adjacent a primary surface of the printed circuit board with the through channel at least partially occluded by the printed circuit board.

The assembly can also include a neutral conductor coupled to a neutral collar in the housing. The printed circuit board can have at least one through-channel and the neutral conductor can extend from the neutral collar through the open channel of the current transformer toward the trip solenoid.

Yet other embodiments are directed to a circuit breaker device that includes a housing; a circuit breaker in the housing having a movable contact arm coupled to a trip lever; and a power conductor having a rigid or semi-rigid body coupled to the housing with a free end portion extending external to the housing.

The housing can include an externally extending angled support member that is coupled to a segment of the power conductor and that is sized and configured to be received in a cooperating second housing of an electronics module with a ground fault circuit.

Still other embodiments are directed to methods for assembling a current interrupter. The methods include: providing a first housing associated with a molded case circuit interrupter with at least one power conductor with a free end portion that extends out of the first housing; and providing a second housing with a ground fault module having a printed circuit board coupled to a trip solenoid. The second housing further includes a current transformer comprising a body defining a center through-channel. The body of the current transformer is parallel to and adjacent a primary surface of the printed circuit board. The methods further include slidably passing the free end portion of the at least one power conductor through the center through channel of the current transformer; and attaching the first housing to the second housing.

The at least one power conductor can be a plurality of power conductors. The slidably passing can be carried out to concurrently pass the free end portion of each of the plurality of power conductors through the center through channel of the current transformer whereby the power conductors electrically couple to collars without loose lengths of wiring, optionally wherein the circuit interrupter is a thermal magnetic two pole or three pole circuit breaker having a rating in a range of 10 A-200 A.

Further features, advantages and details of the present invention will be appreciated by those of ordinary skill in the art from a reading of the figures and the detailed description of the preferred embodiments that follow, such description being merely illustrative of the present invention.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DETAILED DESCRIPTION OF EMBODIMENTS OF THE INVENTION

Figure 1:
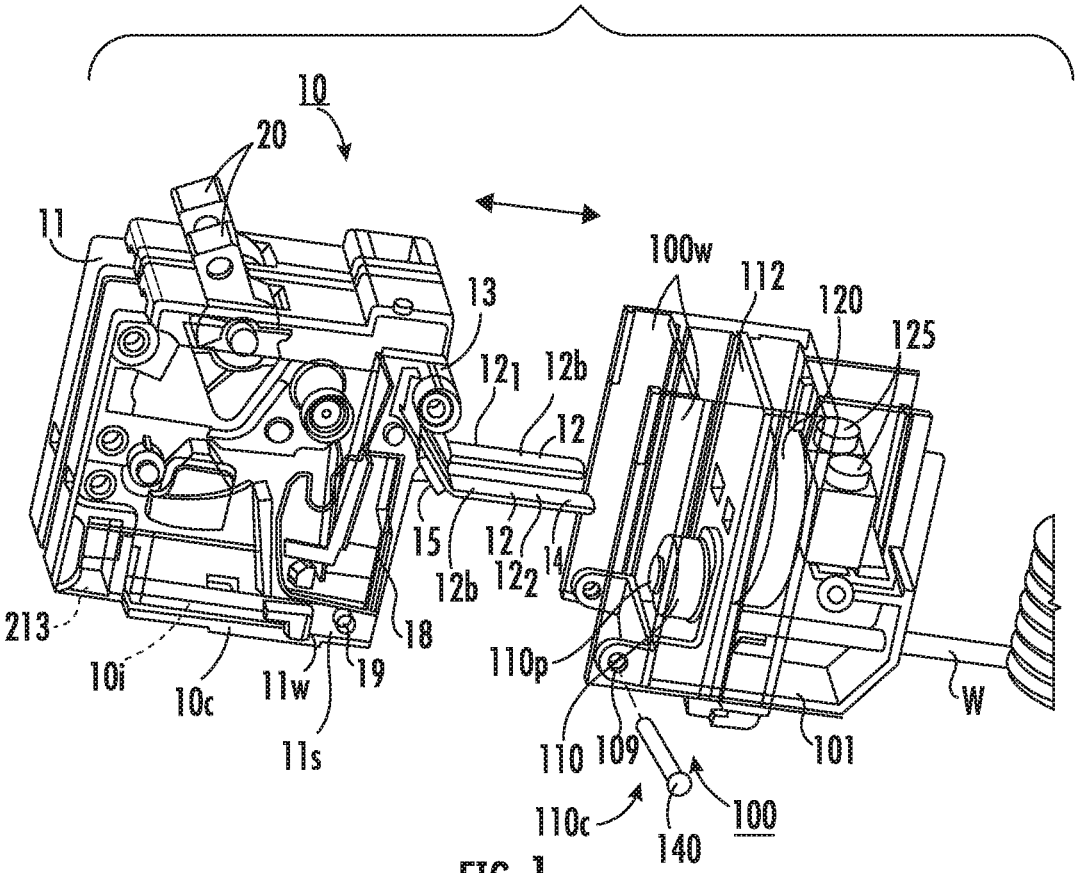
FIG. 1 is an exploded side perspective view of a circuit breaker aligned with a cooperating ground fault module according to embodiments of the present invention.

The present invention now will be described more fully hereinafter with reference to the accompanying drawings, in which illustrative embodiments of the invention are shown. Like numbers refer to like elements and different embodiments of like elements can be designated using a different number of superscript indicator apostrophes (e.g., 10, 10', 10", 10''').

In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art. The term "Fig." (whether in all capital letters or not) is used interchangeably with the word "Figure" as an abbreviation thereof in the specification and drawings. In the figures, certain layers, components or features may be exaggerated for clarity, and broken lines illustrate optional features or operations unless specified otherwise. In addition, the sequence of operations (or steps) is not limited to the order presented in the claims unless specifically indicated otherwise.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "bottom", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass orientations of above, below and behind. The device may be otherwise oriented (rotated 90° or at other orientations) and the spatially relative descriptors used herein interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

The term "about" refers to numbers in a range of +/−20% of the noted value.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Turning now to the figures, FIG. 1 illustrates a circuit interrupter device 10 comprising a first housing 11 aligned with a second housing 101. The first housing 11 can enclose circuit interrupter 10*i*. The second housing 101 comprises a cooperating ground fault module 100. In some embodiments, the first housing 11 encloses or holds a thermal magnetic circuit breaker 10*c* as the circuit interrupter 10*i*.

Figure 3:
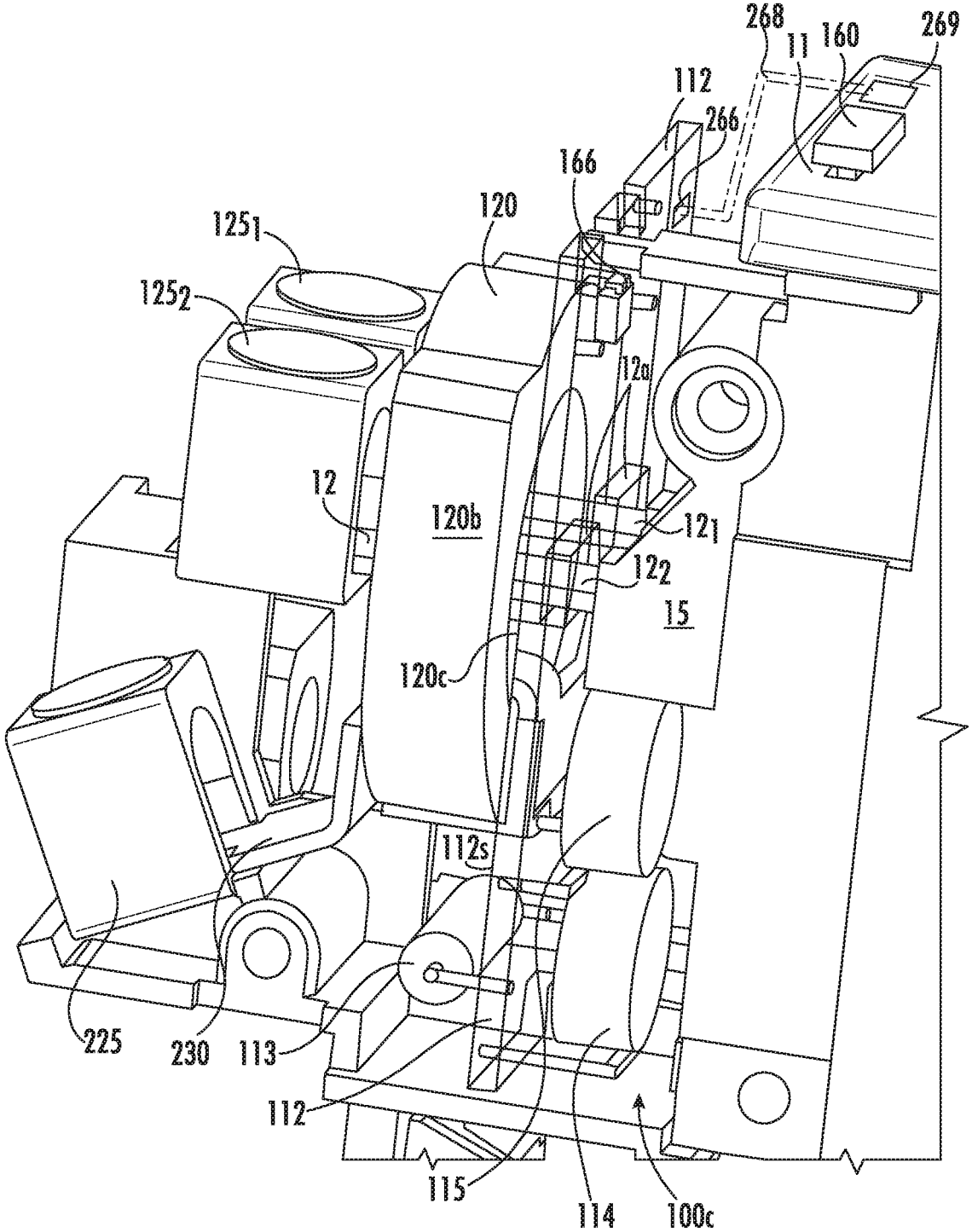
FIG. 3 is a greatly enlarged assembled view of some of the components shown in FIG. 1 according to embodiments of the present invention.

The second housing 101 with the ground fault module 100 has a ground fault circuit 100*c* including at least one printed circuit board 112 comprising electronic circuit components, e.g., capacitors and at least one power resistor, 113, 114, 115 (FIG. 3). The second housing 101 can also include a current transformer (CT) 120, and at least one collar 125 (one for each pole) for connecting to incoming wire(s). Ground fault electronics are well known to those of skill in the art.

In some embodiments, the second housing 101 can also include a trip solenoid 110 with a plunger 110*p* that is aligned with a trip lever 18 in the first housing 11. Electronic tripping of a circuit breaker 10*b* as the circuit interrupter 10*i* is via the solenoid 110 which generates a magnetic field to attract the (steel) trip lever 18 mounted in the first housing 11.

Figure 2:
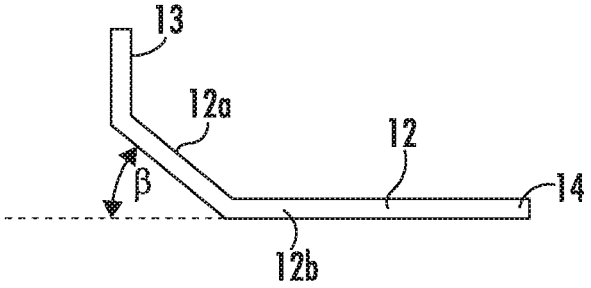
FIG. 2 is an enlarged schematic illustration of an example power conductor

Referring to FIGS. 1-3, the circuit interrupter device 10 can include at least one power conductor 12. The term "power conductor" can also be described as a "load terminal". As shown in FIGS. 1 and 3, the at least one power conductor 12 can be provided as a plurality of adjacent, parallel power conductors 12. The plurality of power conductors 12 can be provided as a first power conductor $\mathbf{12}_1$ for a first pole/phase and a second power conductor $\mathbf{12}_2$ for a second pole/phase for a two pole configuration. However, the at least one power conductor 12 can also be provided as a single power conductor for a single pole configuration or as three power conductors for a three pole configuration.

Referring to FIGS. 1-3, each power conductor 12 can each comprise a rigid or semi-rigid body 12*b* with a free end portion 14. The term "semi-rigid" means that the power conductor 12 has sufficient rigidity to have a self-supporting shape without requiring any support but may flex under load. As shown, the power conductors 12 can have a primary body segment 12*b* that is planar and that can extend a distance out of the first housing 11. Where the power conductor 12 is a plurality of power conductors, the primary body segments 12*b* of each power conductor 12 can be parallel, and co-planar as shown in FIG. 1. However, it is also contemplated that the primary body segments 12*b* of the different power conductors $\mathbf{12}_1$, $\mathbf{12}_2$ can be parallel but reside in different planes, one offset from another (one above the other in the orientation shown in FIG. 1) a defined distance (not shown). It is contemplated that providing a "pass-through" terminal-to-terminal connection without requiring lengths of loose wires (other than the customer input load-side lines to the collar(s) 125) can provide an easier assembly than conventional ground fault circuits in circuit breakers which require lengths of loose wire that can become tangled or be difficult to connect and/or assemble.

For example, in conventional two-pole ground fault devices, manual routing of two phase wires and a neutral return are directed using loose wires through a common current balancing transformer. The manual routing of these loose wire conductors can complicate the assembly process while also "locking" the (thermal magnetic) circuit breaker to the ground fault electronics as a unit so that if there is a defect, the entire device is disassembled for repair. The use of the second housing 101 and the first housing 11 can allow the sub-assemblies to be fabricated separately and paired by aligning which occurs as the ground fault (electronics) module 100*c* and circuit interrupter 10*i* are paired as part of the assembly process. Defective sub-units, either 11 or 101, can be corrected more efficiently and with less scrap. The aligning can include orienting the first housing 11 with the power conductors 12 held by the first housing 11 to face the other housing 101 and inserting the phase power conductors 12 through the current transformer 120 and into in breaker load collar(s) 125 as the first and second housings 11, 101 are coupled together.

As shown in FIG. 1, a first end portion 13 of the power conductor 12 can reside inside the first housing 11. An opposing second end portion 14 can be a free end that can extend into the second housing 101 when assembled to the first housing 11. However, it is contemplated that the at least one power conductor 12 can be configured so that the free end 14 faces the first housing 11 and the fixed end 13 can be coupled to the second housing 101. This embodiment may also include a clamp or other member to provide a sound electrical coupling. Where a plurality of power conductors 12 are used, one power conductor 12 can be configured with the free end 14 extending into the second housing 101 and another one can be configured with its free end 14 extending into the first housing 11 (not shown).

Figure 6:
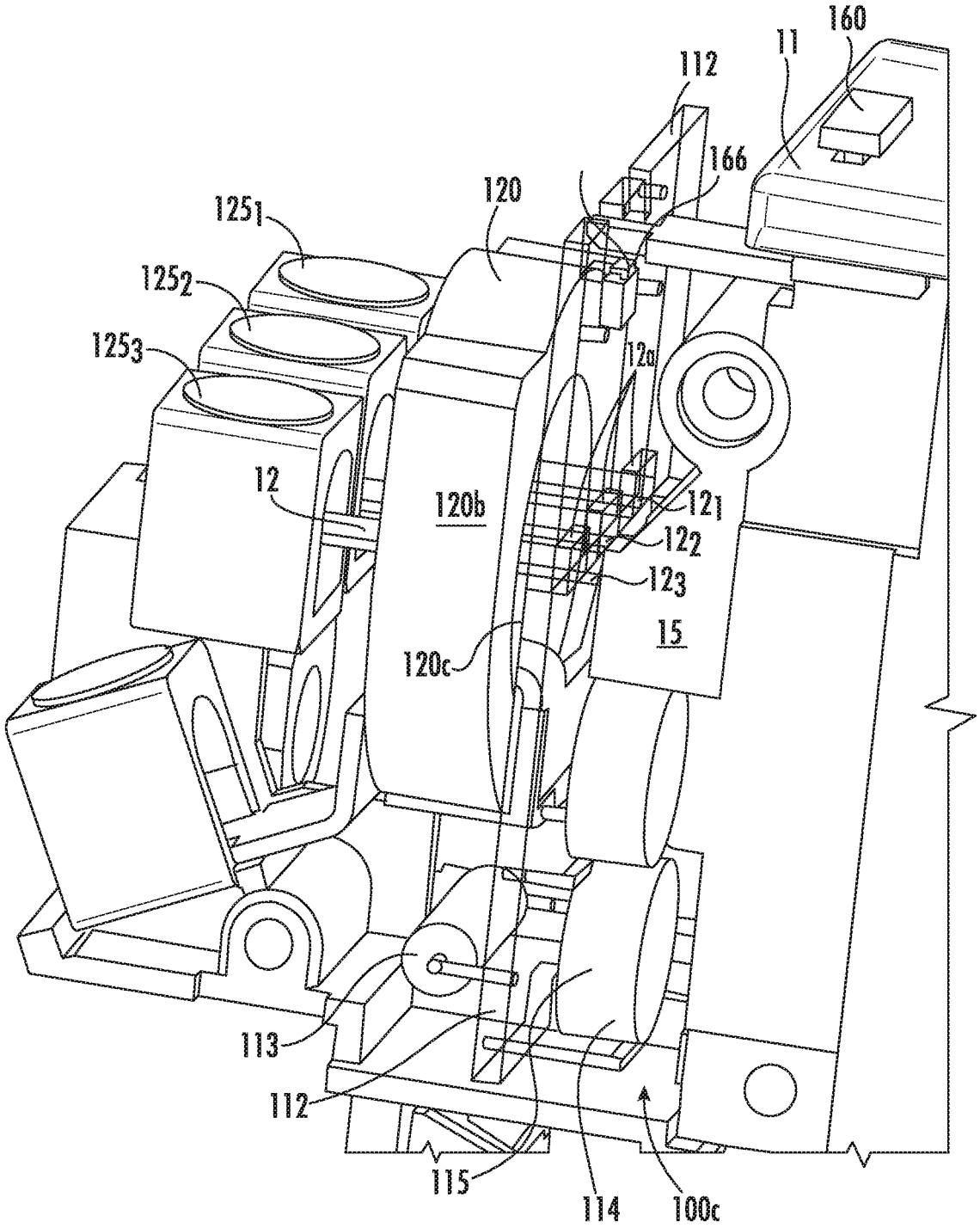
FIG. 6 is a schematic illustration of an example three pole device according to embodiments of the present invention.

Referring to FIGS. 1 and 3, the at least one power conductor 12 is configured to extend through (e.g., "pass-through") an open channel 120*c* defined by a cylindrical body 120*b* of a single current transformer (CT) 120. Where the circuit interrupter device 10 is a multi-pole device, i.e., a two pole device as shown in FIGS. 1 and 3 or a three pole device as shown in FIG. 6, each power conductor 12 can extend concurrently extend through (e.g., "pass-through") an open channel 120*c* defined by the cylindrical body 120*b* of the single current transformer (CT) 120. FIG. 3 illustrates two adjacent collars $\mathbf{125}_1$, $\mathbf{125}_2$ and two corresponding power conductors $\mathbf{12}_1$, $\mathbf{12}_2$, each power conductor extending through a single CT 120. FIG. 6 illustrates three adjacent collars $125_1$, $125_2$, $125_3$ and three corresponding power conductors $12_1$, $12_2$, $12_3$ all extending through a single CT 120. Using a single common CT 120 for each pole/phase may allow for more precise measurement of current imbalance if it exists and/or to achieve desired amperage leakage protection.

In some embodiments, the circuit interrupter device 10 is configured to have a 4-5 mA current leakage protection rating. See, UL 943, which governs 5 mA devices and/or NEC (National Electric Code) which mandates 5 mA ground fault protection on many residential/commercial electrical branch circuits, the contents of which are hereby incorporated by reference as if recited in full herein.

In some embodiments, the circuit interrupter device 10 can be configured to have a 20 mA or 30 mA current leakage protection rating. See, UL 1053 which governs 30 mA devices, the contents of which are hereby incorporated by reference as if recited in full herein.

FIGS. 1 and 3 illustrate that the at least one printed circuit board 112 comprises a plurality of open channels 112*a*, each channel 112*a* configured to allow a single power conductor 12 to pass through and into adjacent collars 125. In some embodiments, the circuit interrupter device 10 can have one or more branches with shared ground fault circuit components provided on the same or different printed circuit boards 112.

Figure 4A:
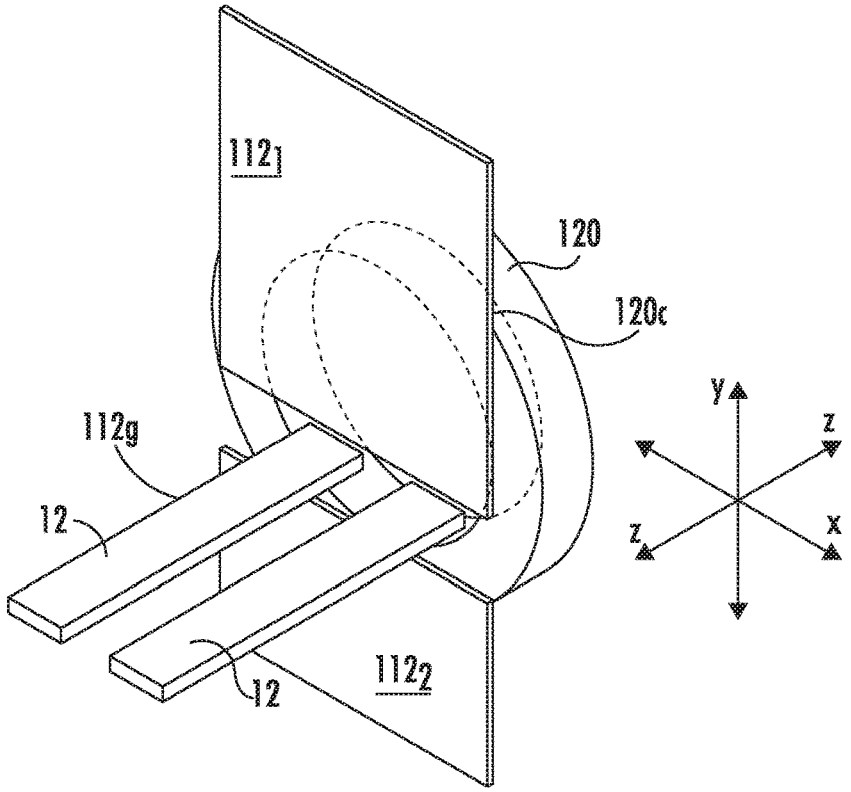
FIG. 4A is schematic illustration of a portion of a ground fault module according to embodiments of the present invention.

As shown in FIG. 4A, the at least one printed circuit board 112 can be provided as first and second printed circuit boards $112_1$, $112_2$ arranged to define an open gap space therebetween 112*g* that allow the at least one power conductor 12 to pass through.

Figure 4B:
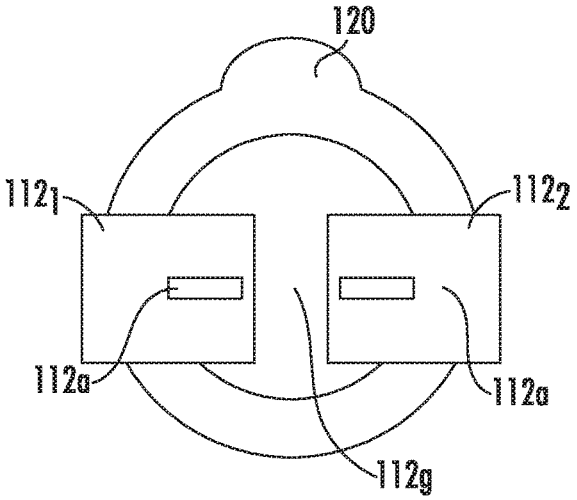
FIG. 4B is schematic illustration of another embodiment of a portion of a ground fault module according to embodiments of the present invention.

FIG. 4B also shows that the at least one printed circuit board 112 can be provided as first and second printed circuit boards $112_1$, $112_2$ arranged to define an open gap space therebetween 112*g* that allow one of the at least one power conductor 12 to pass through. One or both of the first and second printed circuit boards $112_1$, $112_2$ can include the channel 112*a* that is configured to allow another power conductor 12 to pass through. The configuration shown may be particularly suitable for a three pole device.

The first and second printed circuit boards $112_1$, $112_2$ can be co-planar or parallel in stacked or laterally and offset relationships in any or all of x, y and/or z dimensions.

Figure 4C:
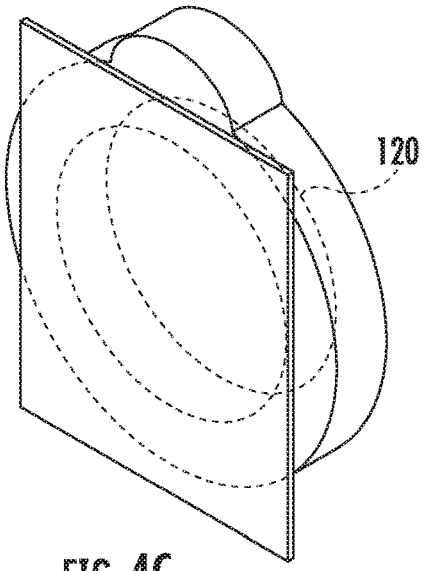
FIG. 4C is schematic illustration of another embodiment of a portion of a ground fault module according to embodiments of the present invention.

FIG. 4C shows a single printed circuit board 112 with a single channel 112*a* that can concurrently allow a plurality of power conductors 12 to pass through and into the collars 125.

The current transformer 120 may have at least part of its open channel 120*c* (FIG. 3) occluded by the adjacent at least one printed circuit board 112 (FIGS. 1, 3, 4A-4C). The current transformer 120 can have a width and/or length dimension that is greater than a corresponding width and/or length dimension of the adjacent at least one printed circuit board 112.

Referring again to FIG. 1, the power conductor 12 can be coupled to a support member 15 that extends external to the first housing 11 in a direction facing the second housing 101 and that is enclosed in the second housing 101 when the first and second housings 11, 101 are assembled together. The support member 15 can be inclined at an angle of between 30-60 degrees relative to the primary body segment 12*b* of the power conductor 12. The support member 15 can inhibit bending for ease of assembly and alignment, for example.

As shown in FIG. 2, the power conductor 12 can have an angled segment 12*a* that resides between the first end portion 13 and the opposing second (free) end portion 14, shown as closer to the first end portion 13. The angled segment 12*a* can have an angle "β" that is in a range of 30-60 degrees relative to the body segment 12*b*. The first end portion 13 can be orthogonal to the second end portion 14 and/or body segment 12*b* of the power conductor 12. The first end portion 13 of the power conductor 12 can couple to a line bus and/or the circuit interrupter 10*i* in the first housing 11.

The shape and position of the support member 15 and the shape and position of the at least one power conductor 12 can be configured to occupy a small footprint space in the housing 11 and/or housing 101.

Referring to FIGS. 1 and 3, the primary body segment 12*b* of the power conductor 12 can be oriented perpendicular to a primary surface 112*s* of the printed circuit board 112. The printed circuit board 112 can be parallel to the primary body 120*b* of the current transformer 120.

As shown in FIG. 1, the first housing 11 can have outer walls 11*w* with apertures 19 and the second housing 101 can have apertures 109 that align with the apertures 19 and receive fixation members to affix the first and second housings 11, 101 together.

The outer wall 100*w* of the second housing 101 can form an outer wall of the circuit interrupter device 10. A sub-portion 11*s* of the outer wall 11*w* of the first housing 11 can reside inside the adjacent outer wall 100*w* of the second housing 101.

One or more bolts, rivets, screws or other attachment member(s) 140 (FIG. 1) can extend through the respective aligned aperture 19, 109 to couple the second housing 101 with the ground fault module 100 to the first housing 11 and form the assembled housing of the circuit interrupter device 10. In some embodiments, the first and second housings 11, 101 can slidably engage and be attached together, optionally using a single fixation member 140 such as a single rivet. In some embodiments, the first and second housings 11, 101 can frictionally engage such as via a snap fit configuration. In some embodiments, the coupling features such as protrusions and recesses or rails and channels and the like can be integrated into the housings without requiring an additional fixation member.

Referring to FIG. 3, with the second housing 101 omitted for ease of reference, the first and second housings 11, 101 can be attached together with the power conductors 12 coupled to respective load collars $125_1$, $125_2$ to couple to incoming wires for a load side connection when assembled in the field. Each power conductor 12 can have a length sufficient to extend out of the first housing 11 into the second housing 101 and into a respective collar $125_1$, $125_2$, typically by directly extending through at least one aperture 112*a* in at least one printed circuit board 112, and through a common (single one) current transformer (CT) 120. FIG. 3 illustrates two adjacent channels 112*a* in the printed circuit board 112, one for each power conductor 12. However, as discussed above a single aperture may be used or the at least one printed circuit breaker can be provided as a plurality of printed circuit boards and the power conductors can be configured to extend over, under or about an outer perimeter of one or more printed circuit board 112.

As shown in FIG. 3, the second housing 101 can also include a neutral collar 225 with a neutral conductor 230 that extends through the current transformer 120. The neutral conductor 230 can be rigid or semi-rigid and may angle upward toward the load collars 125 in a direction toward the first housing 11. The neutral conductor 230 and the power conductors 12 can all concurrently extend through the same current transformer 120. The current transformer 120 can be referred to as a "balancing" current transformer as the current transformer 120 can balance the current associated with the power conductors 12 with current associated with the neutral conductor 230 as is well known to those of skill in the art.

As also shown in FIG. 3, the first housing 11 can include a test button 160 that is coupled to an externally accessible switch 166 in the second housing 101 typically held by the printed circuit board 112 for allowing a user to initiate an operational test of the functionality of the ground fault circuit 100*c*. Additionally shown in FIG. 3, at least one LED 266 can be held by the printed circuit board 112. The at least one LED 266 can provide a fault diagnostic light output signal (code) at a light transmissive window 269 in the housing 10*h*, shown as adjacent the externally accessible switch 166. The window 269 can be provided as an opening in the housing but typically has a transparent or translucent cover. A light transmission path 268 can be used to direct light from the LED 266 to the window 269. The light transmission path 268 can be provided by one or more of a light pipe, fiber optic cable or conduit other suitable light transmission member.

Figure 5:
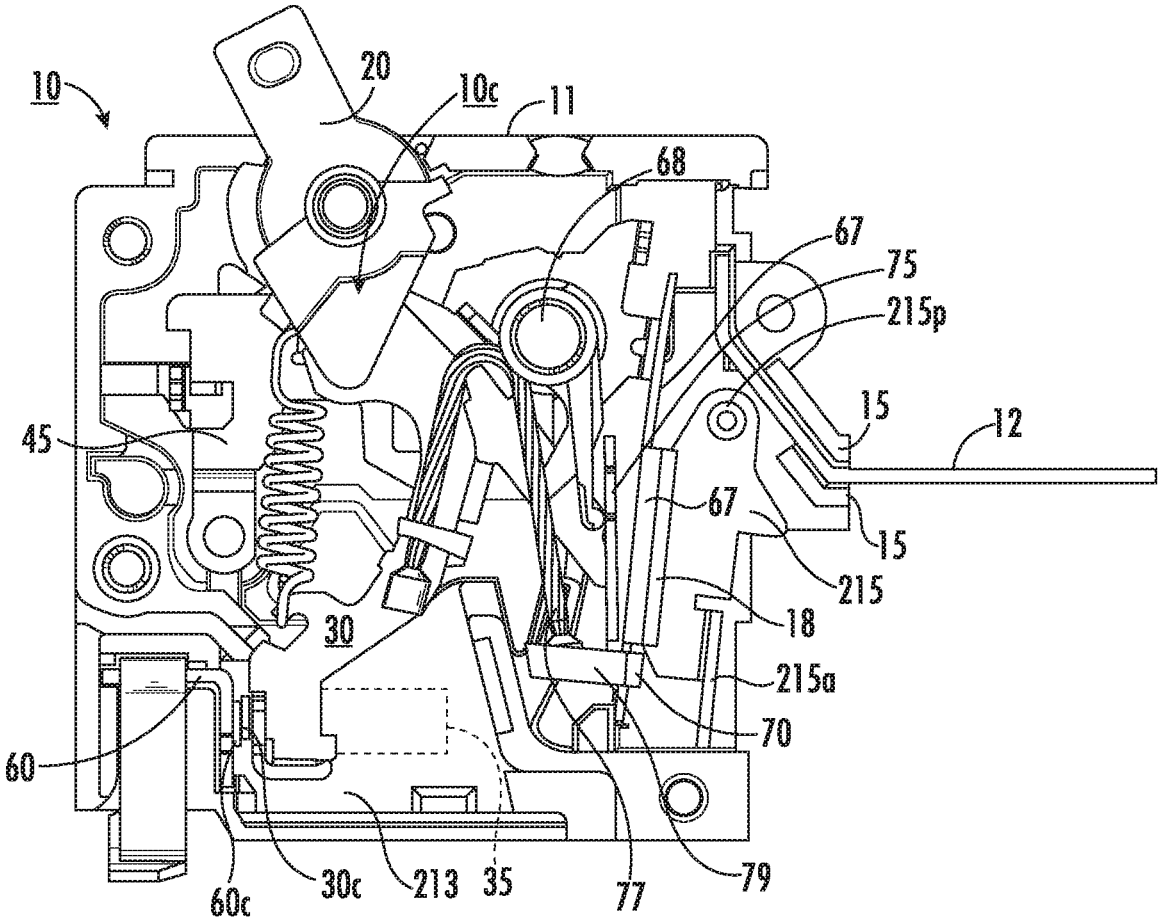
FIG. 5 is a partial internal view of an example circuit interrupter device according to embodiments of the present invention.

Referring to FIG. 5, the first housing 11 can hold a lever 215. The lever 215 comprises ferromagnetic material such as steel. The first housing 11 can also hold a movable contact arm 30 with an electrical contact 30*c*. The movable contact arm 30 engages a handle 20 and a mechanism spring (not shown, but well known to those of skill in the art). The first housing 11 can also include at least one trip cam 68, a cradle 45, a bimetal member 67, a magnet 70, armature 75, shunt 77, and shunt bracket 79, for example. The housing 11 can also include an arc chute 35 and line terminal assembly 60 with a stationary electrical contact 60*c*. The first housing 11 can have an internal cavity 213 that receives and holds one side of the arc chute 35 therein.

The lever 215 can be pivotably coupled to the housing 11 to be able to pivot about a pivot joint 215*p*. As is well known to those of skill in the art, the lever 215 is sized and configured to be able to be magnetically pulled toward a magnetized or magnetic member coupled to the solenoid 110 (FIG. 1) in the ground fault module 100. The lever 215 can have an arm 215*a* that extends toward the movable arm 30 and can reside in, front of the armature 75. The magnetized or magnetic member pulls the lever 215 via magnetic attraction in a direction away from the line side contact terminal assembly 60 which unlatches the circuit breaker 10 in a trip event. The second housing 101 can have at least one printed circuit board 112 coupled to the solenoid 110 and a magnetic or magnetized member and at least one collar assembly 125. The first housing 11 comprises a pivotable lever 215. In operation, the pivotable lever 215 pivots in response to a magnetic force applied by the magnetic or magnetized member of the solenoid 110 to delatch the circuit breaker 10*c*.

The second housing 101 can comprise a thermoplastic material for lower cost options as there is no direct contact with the hot, thermal magnetic portion and/or no direct exposure to high interrupting currents or internal pressures from a high available fault current event, for example. In this embodiment, the first housing 11 can comprise a thermoset material such as glass polyester.

U.S. patent application Ser. No. 15/883,676/PG PUB. 2019/0109452 at FIG. 11 illustrates an example schematic circuit diagram of an exemplary two-pole ground fault circuit 100*c* for the ground fault module 100 according to embodiments of the present invention, the contents of which are hereby incorporated by reference as if recited in full herein. Other ground fault circuit configurations may be employed as will be known to those of skill in the art.

In some embodiments, the circuit breakers 10 can be DC circuit breakers, AC circuit breakers, or both AC (alternating current) and DC (direct current) circuit breakers.

In some embodiments, the circuit interrupter 10 with the ground fault module 100 can be a 10 A-100 A, 22 kA two and/or three pole product or a 100 A and one of a 42 kA, 65 kA or 100 kA product.

The circuit breakers 10 may be high-rated miniature molded case circuit breakers, e.g., 240V and above 50 A in a compact package.

In some embodiments, the circuit interrupter 10 can be provided as a three pole configuration of: 10-100 A, 10-42 ka, 240 v.

In some embodiments, the circuit interrupter 10 can be provided as a two pole configuration of: 120/240 v, 240 v, 10-125 A, 10-100 ka or 277/480 v, 2 pole 15-30 A.

However, it is contemplated that the circuit interrupter device 10 with the ground fault module 100 can be used for any voltage, current ranges and are not limited to any particular application or use. For additional description of example components, see, U.S. Patent Application Publication Serial Number 2019/0109452, the contents of which are hereby incorporated by reference as if recited in full herein.

As discussed above, the circuit interrupters 10 can be molded case circuit breakers (MCCB)s. MCCBs are well known. See, e.g., U.S. Pat. Nos. 4,503,408, 4,736,174, 4,786,885, and 5,117,211, the contents of which are hereby incorporated by reference as if recited in full herein. The circuit breakers 10 can be a bi-directional DC MCCB. See, e.g., U.S. Pat. No. 8,222,983, the content of which is hereby incorporated by reference as if recited in full herein. The DC MCCBs can be suitable for many uses such as data center, photovoltaic, and electric vehicle applications.

Figure 7:
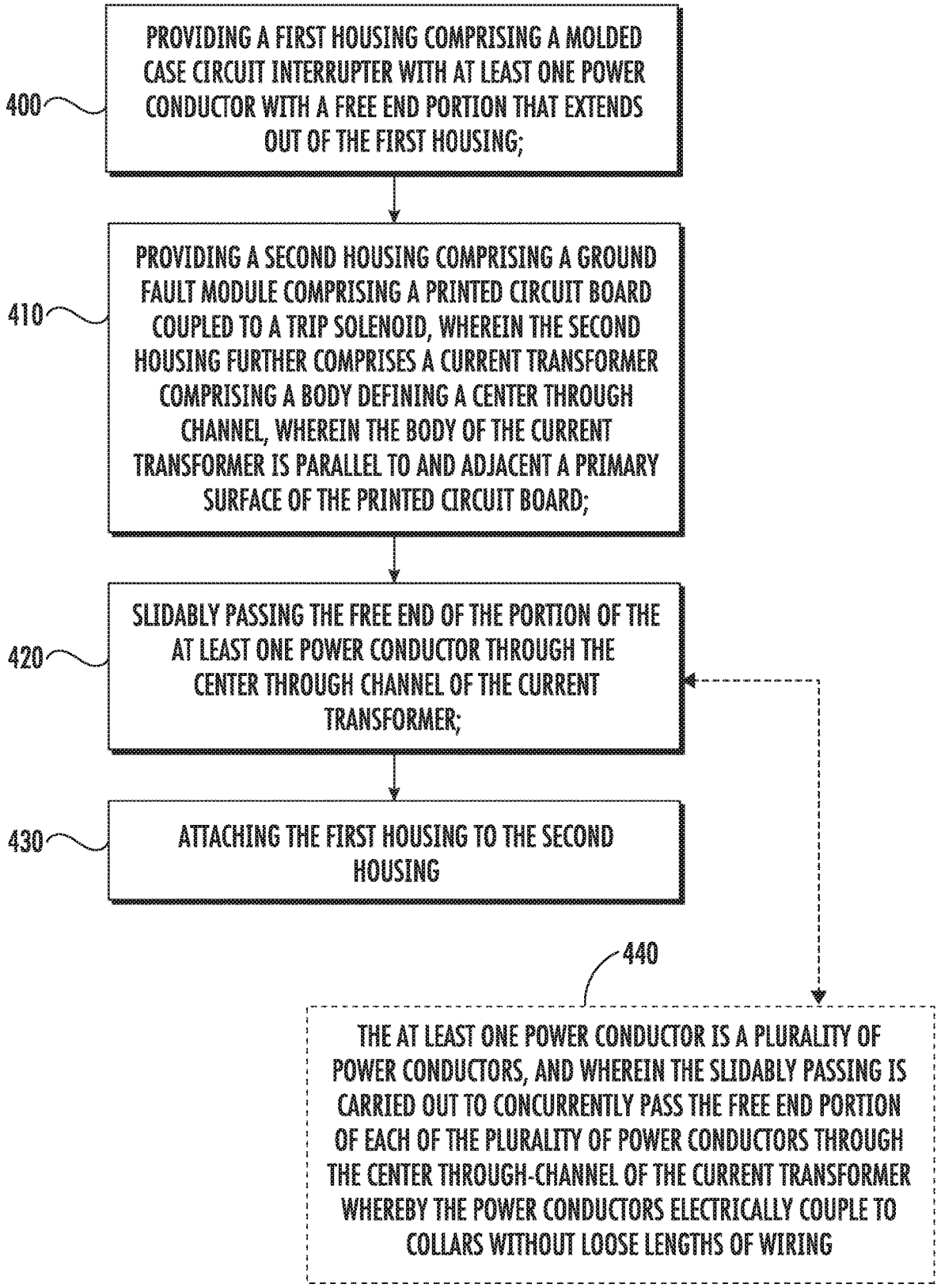
FIG. 7 is a flow chart of an exemplary method of assembling a ground fault module to a circuit breaker according to embodiments of the present invention.

FIG. 7 illustrates features associated with a method of assembling a circuit interrupter. A first housing is provided. The first housing comprises a molded case circuit interrupter with at least one power conductor with a free end portion that extends out of the first housing (block 400). A second housing is provided. The second housing comprises a ground fault module comprising a printed circuit board coupled to a trip solenoid. The second housing further comprises a current transformer comprising a body defining a center through channel, wherein the body of the current transformer is parallel to and adjacent a primary surface of the printed circuit board (block 410). The free end portion of the at least one power conductor is slidably passed through the center through channel of the current transformer (block 420). The first housing is attached to the second housing (block 430).

The at least one power conductor can be a plurality of power conductors and the slidably passing can be carried out to concurrently pass the free end portion of each of the plurality of power conductors through the center through channel of the current transformer whereby the power conductors electrically couple to collars without loose lengths of wiring (block 440).

Optionally wherein the circuit interrupter is a thermal magnetic two pole or a three pole circuit breaker, typically having a rating in a range of 10 A-200 A.

The second housing 101 can comprise at least one printed circuit board in communication with a solenoid a magnetic or magnetized member and at least one collar assembly and the first housing 11 can comprises a pivotable lever that can pivot in response to a force applied by the magnetic or magnetized member to delatch a circuit breaker as the circuit interrupter 10*i*.

The second housing 101 can be smaller than the first housing 11 and the first housing 11 can have an externally accessible pivoting handle 20 coupled to a movable arm with a contact on an end portion thereof.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed:

1. A circuit interrupter device, comprising:
a first housing comprising a circuit interrupter;
a second housing coupled to the first housing;
at least one load collar in the second housing;
a current transformer in the second housing, wherein the current transformer has an open channel;
at least one power conductor having a rigid or semi-rigid body with opposing first and second end portions extending between the first and second housings, wherein the second end portion extends through the open channel in the current transformer into the at least one load collar; and
a support member coupled to the first housing and also coupled to a segment of the at least one power conductor,
wherein the support member is inclined and extends external of the first housing into the second housing.

2. The circuit interrupter device of claim 1, wherein the second housing further comprises a ground fault circuit.

3. The circuit interrupter device of claim 1, wherein the first end portion of the at least one power conductor is coupled to the first housing.

4. The circuit interrupter device of claim 1, wherein the first end portion of the rigid or semi-rigid body is perpendicular to the second end portion.

5. The circuit interrupter device of claim 1, further comprising at least one printed circuit board in the second housing that has a primary surface that is perpendicular to the second end portion of the at least one power conductor and that is adjacent the current transformer.

6. The circuit interrupter device of claim 5, wherein the primary surface of the at least one printed circuit board is parallel to a primary body of the current transformer in the second housing.

7. The circuit interrupter device of claim 5, further comprising a solenoid in the second housing that is coupled to the at least one printed circuit board and that faces the first housing, aligned with a cooperating trip lever in the first housing.

8. The circuit interrupter device of claim 5, wherein the at least one printed circuit board is parallel to a primary body of the current transformer and resides closer to the first housing than the current transformer.

9. The circuit interrupter device of claim 5, wherein the at least one power conductor is provided as a plurality of adjacent and parallel power conductors that concurrently extend through the open channel of the current transformer.

10. The circuit interrupter device of claim 9, wherein the circuit interrupter device is a two pole device, and wherein the second housing comprises a ground fault circuit that is coupled to a circuit breaker as the circuit interrupter in the first housing.

11. The circuit interrupter device of claim 1, wherein the first housing and the second housing each comprise apertures on first and second spaced apart corner portions that are sized and configured for receiving a fixation member to attach the first housing to the second housing.

12. A circuit interrupter device, comprising:
a first housing comprising a circuit interrupter;
a second housing coupled to the first housing;
at least one load collar in the second housing;
a current transformer in the second housing, wherein the current transformer has an open channel; and
at least one power conductor having a rigid or semi-rigid body with opposing first and second end portions extending between the first and second housings, wherein the second end portion extends through the open channel in the current transformer into the at least one load collar,
wherein the first end portion of the rigid or semi-rigid body is perpendicular to the second end portion, and
wherein the rigid or semi-rigid body of the at least one power conductor has an intermediate segment between the first and second end portions that extends at an angle between 30-60 degrees from the second end portion.

13. A circuit interrupter device, comprising:
a first housing comprising a circuit interrupter;
a second housing coupled to the first housing;
at least one load collar in the second housing;
a current transformer in the second housing, wherein the current transformer has an open channel;
at least one power conductor having a rigid or semi-rigid body with opposing first and second end portions extending between the first and second housings, wherein the second end portion extends through the open channel in the current transformer into the at least one load collar;
at least one printed circuit board in the second housing that has a primary surface that is perpendicular to the second end portion of the at least one power conductor and that is adjacent the current transformer; and
a neutral conductor coupled to a neutral collar in the second housing, wherein the at least one printed circuit board comprises at least one through-channel, and wherein the at least one power conductor extends through the at least one through-channel of the at least one printed circuit board, then through the open channel in the current transformer, then into a respective load collar of the at least one load collar, and wherein the neutral conductor also extends through the open channel of the current transformer.

14. A ground fault assembly, comprising:
a housing comprising a plurality of load collars;
a printed circuit board coupled to a trip solenoid in the housing; and
a current transformer in the housing comprising a body defining a center through channel residing adjacent the printed circuit board, wherein the body of the current transformer is parallel to and adjacent a primary surface of the printed circuit board with the through channel at least partially occluded by the printed circuit board, wherein the ground fault assembly further comprises a neutral conductor coupled to a neutral collar in the housing, and wherein the printed circuit board comprises at least one through-channel.

15. The ground fault assembly of claim 14, wherein the neutral conductor extends from the neutral collar through the center through channel of the current transformer toward the trip solenoid.

* * * * *